US010208978B2

(12) United States Patent
Berg

(10) Patent No.: US 10,208,978 B2
(45) Date of Patent: Feb. 19, 2019

(54) SYSTEM FOR GENERATING ELECTRICAL ENERGY FROM WASTE ENERGY

(71) Applicant: Lennox Industries Inc., Richardson, TX (US)

(72) Inventor: Eric Berg, Richardson, TX (US)

(73) Assignee: Lennox Industries Inc., Richardson, TX (US)

( * ) Notice: Subject to any disclaimer, the term of this patent is extended or adjusted under 35 U.S.C. 154(b) by 605 days.

(21) Appl. No.: 13/672,071

(22) Filed: Nov. 8, 2012

(65) Prior Publication Data

US 2014/0123695 A1 May 8, 2014

(51) Int. Cl.

| | |
|---|---|
| ***F24F 12/00*** | (2006.01) |
| ***F25B 27/02*** | (2006.01) |
| ***F25B 27/00*** | (2006.01) |
| ***F24F 11/30*** | (2018.01) |
| ***F24F 11/62*** | (2018.01) |
| *F25B 13/00* | (2006.01) |

(52) U.S. Cl.

CPC ..... *F24F 12/00* (2013.01); *F24F 11/30* (2018.01); *F24F 11/62* (2018.01); *F25B 27/00* (2013.01); *F25B 13/00* (2013.01)

(58) Field of Classification Search

CPC ..... F25B 21/02; F25B 2321/02; F25B 27/00; F25B 13/00; F25B 27/005; F25B 27/02; H01L 35/00; H01L 41/00; F24F 12/00; F24F 11/006

USPC ..... 62/331, 236, 134, 3.2, 3.3, 3.7, 56; 318/116

See application file for complete search history.

(56) References Cited

U.S. PATENT DOCUMENTS

| | | | | |
|---|---|---|---|---|
| 4,059,772 | A * | 11/1977 | Wilkerson | F03G 3/00 307/46 |
| 4,366,388 | A * | 12/1982 | Wilkerson | H02J 3/32 307/150 |
| 7,081,684 | B2 * | 7/2006 | Patel | H01L 35/00 136/205 |
| 7,348,683 | B2 * | 3/2008 | Riesberg | F03G 7/08 290/1 R |
| 7,493,974 | B1 * | 2/2009 | Boncodin | B60K 16/00 180/2.2 |
| 8,220,568 | B2 * | 7/2012 | Stoicoviciu | B60K 25/08 180/165 |
| 2002/0131868 | A1 * | 9/2002 | Joo | F04B 35/04 417/53 |
| 2003/0093995 | A1 * | 5/2003 | Tadayon | F01K 3/185 60/651 |
| 2004/0244385 | A1 * | 12/2004 | Gatecliff | F04B 39/06 62/3.3 |

(Continued)

FOREIGN PATENT DOCUMENTS

| | | | | |
|---|---|---|---|---|
| DE | 10246837 | A1 * | 5/2003 | B60G 13/14 |
| DE | 10246837 | A1 * | 5/2003 | B60G 13/14 |

(Continued)

*Primary Examiner* — Len Tran
*Assistant Examiner* — Kirstin U Oswald
(74) *Attorney, Agent, or Firm* — Baker Botts L.L.P.

(57) ABSTRACT

A power-generating system comprising an energy-converting module that converts non-electrical waste energy generated by one or more components of an HVAC system into electrical energy, and, a control module that directs the electrical energy to one or more electricity-consuming components of the HVAC system.

8 Claims, 2 Drawing Sheets

(56) References Cited

U.S. PATENT DOCUMENTS

2004/0256082 A1* 12/2004 Bracciano ..... B60H 1/00392 165/42
2006/0175877 A1* 8/2006 Alionte ..... A47C 7/74 297/180.14
2006/0266043 A1* 11/2006 Jerome ..... F01K 15/04 60/651
2007/0017666 A1* 1/2007 Goenka ..... B60H 1/004 165/202
2007/0090726 A1* 4/2007 Morris ..... F04D 29/023 310/330
2007/0101737 A1* 5/2007 Akei ..... F25B 1/00 62/238.6
2007/0101740 A1* 5/2007 Akei ..... F25B 1/00 62/238.7
2007/0101750 A1* 5/2007 Pham ..... F25B 25/00 62/332
2008/0209913 A1* 9/2008 Sung ..... B60H 1/2221 62/3.61
2009/0018668 A1* 1/2009 Galbraith ..... B01J 20/3441 623/23.65
2009/0093911 A1* 4/2009 Caillat ..... F04B 39/0027 700/280
2009/0100841 A1* 4/2009 Kahn ..... G06F 1/20 62/3.2
2009/0121489 A1* 5/2009 Kawai ..... F03D 5/06 290/55
2009/0205695 A1* 8/2009 Makansi ..... H01J 45/00 136/201
2009/0296348 A1* 12/2009 Russell ..... H02S 40/32 361/702
2010/0127572 A1 5/2010 Uselton et al.
2010/0146990 A1* 6/2010 Taras ..... F04B 35/04 62/3.2
2012/0169067 A1* 7/2012 Ruan ..... F24H 4/06 290/1 R

FOREIGN PATENT DOCUMENTS

EP 1617081 B1 * 9/2012 ..... F04C 18/02
EP 1617081 B1 * 9/2012 ..... F04C 23/008

* cited by examiner

SYSTEM FOR GENERATING ELECTRICAL ENERGY FROM WASTE ENERGY

TECHNICAL FIELD

This application is directed to a system for generating power from waste energy of an HVAC system, an HVAC system having the power-generating system and, a method of assembling the power-generating system.

BACKGROUND

Often, the electrically-powered components of heating, ventilation, air-conditioning (HVAC) systems are powered by a power source that is separate from the system itself. Some of these the electrically-powered components require significant continuous or intermittent power even when the system is not in a running cycle, thereby reducing the over-all energy efficiency of the system. Moreover, proposed government regulation of maximal off-cycle power consumption could limit the commercial viability of certain HVAC systems having high off-cycle power consumption requirements.

SUMMARY

One embodiment of the present disclosure is a power-generating system. The system comprises an energy-converting module that converts non-electrical waste energy, generated by one or more components of an HVAC system, into electrical energy. The system comprises a control module that directs the electrical energy to one or more electricity-consuming components of the HVAC system.

Another embodiment of the present disclosure is an HVAC system. The HVAC system comprises an outdoor heat exchanger equipped with an outdoor air-mover and an indoor heat exchanger equipped with an indoor air-mover. The HVAC system also comprises a compressor configured to compress a refrigerant and configured to transfer the refrigerant to a discharge line and to receive the refrigerant from a suction line. The HVAC system further comprises the above-described power generating system. The energy-converting module converts non-electrical waste energy, generated by one or more of the indoor air-mover, the outdoor air-mover, the compressor, or the discharge line, into electrical energy. The control module directs the electrical energy to one or more electricity-consuming components of the HVAC system.

Another embodiment of the present disclosure is a method of assembling a power generating system. The method comprises providing an energy-converting module that converts non-electrical waste energy, generated by one or more components of an HVAC system, into electrical energy. The method also comprises providing a control module that directs the electrical energy to one or more electricity-consuming components of the HVAC system.

BRIEF DESCRIPTION

Reference is now made to the following descriptions taken in conjunction with the accompanying drawings, in which.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

The embodiments of the power-generating systems of the present disclosure provide an internal electrical power source that is separate from external input power from the electrical grid or other external power source. Certain embodiments of the power-generating system can be used to power various electricity-consuming components of the HVAC system during off-cycles, thereby improving the energy efficiency of the HVAC system.

Figure 1:
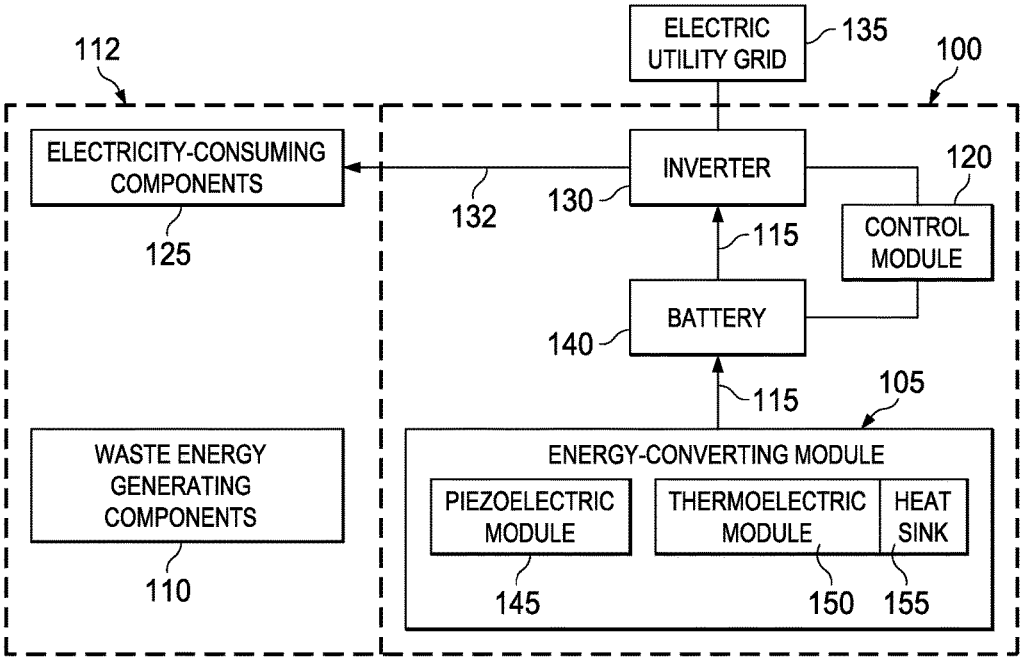
FIG. 1 illustrates a block diagram of an example power-generating system of the disclosure.

One embodiment of the present disclosure is a power-generating system. FIG. 1 illustrates a block diagram of an example power-generating system 100 of the disclosure. The system 100 comprises an energy-converting module 105 that converts non-electrical waste energy generated by one or more components 110 of an HVAC system 112 into electrical energy. For instance, the electrical energy can be embodied in the form of a direct current 115 transmitted through a conductive line from the energy-converting module 105. The system 100 also comprises a control module 120 that directs the electrical energy to one or more electricity-consuming components 125 of the HVAC system 112.

Some embodiments of the control module 110 can include an integrated circuit that is programmed to operate electrical switches to facilitate directing the electrical energy to the one or more electricity-consuming components 125, or, other components of the power-generating system 100 (e.g., an inverter or a battery).

Some embodiments of the system 100 further include an inverter 130 configured to convert the electrical energy (e.g., direct current 115) into an alternating current 132. In some cases, for instance, the control module 120 is configured to regulate amounts of the alternating current 132 directed to the electricity-consuming components by the inverter 130. In some cases, for instance, the control module 120 is further configured to direct excess amounts of the electrical energy e.g., excess amounts of the energy that cannot be presently used by the one or more electricity-consuming components 125, from the inverter 130 to an electric utility grid 135.

In some embodiments, the inverter 130 can be configured as a utility-interactive inverter, such as described in U.S. patent application Ser. No. 12/641,154, which is incorporated by reference herein in its entirety. For instance, when excess amounts of the electrical energy are being produced by the energy-converting module 105, the excess energy can be directed by the control module 120 to the electric utility grid 135.

Some embodiments of the system 100 further include a battery 140 configured to store the electrical energy (e.g., direct current 115 produced by the energy-converting module 105). For instance, in some cases, the control module 120 is configured to regulate amounts of the electrical energy stored in the battery 140. As part of regulating amounts of the electrical energy stored in the battery 140, the control module 120 can control the delivery of the stored electrical energy as a direct current 115 to an inverter 130 for transformation into the alternating current 132. In some cases, the control module 120 can regulate amounts of the alternating current 132 sent to the electricity-consuming components 125 that are configured to be powered by the alternating current 132. In some cases, the control module 120 can regulate the delivery of the battery-stored electrical energy as a direct current 115, directly to the electricity-consuming components 125 that are configured to be powered by a direct current.

In some cases, the energy-converting module 105 includes a piezoelectric module 145 configured to convert the non-electrical waste energy in the form of mechanical vibrations generated by the one or more components 10. In some cases, the energy-converting module 120 includes a thermo-electric module 150 configured to convert the non-electrical waste energy in the form of heat generated by the one or more components 110. In some cases, the system 100 further includes a heat sink 155 configured to be mounted to the thermoelectric module 150. One skilled in the art would be familiar with the various types of piezoelectric semiconductor materials or thermoelectric semiconductor materials that could be used to form the modules 145, 150.

In some embodiments of the system 100, it is advantageous for the energy-converting module to include both the piezoelectric module 145 and the thermoelectric module 150. because these modules 145, 150 can convert the waste energy from different components 110, or, at least from non-overlapping portions of the same component 110. Therefore, the combination of these modules 145, 150 can generate more electrical energy as compared to having only one type of energy-converting module in the system 100. For instance, in some cases, the piezoelectric module 145 converts the non-electrical waste energy configured as mechanical vibrations generated by one of the components 110 of the HVAC system 100, and, the thermoelectric module 150 converts the non-electrical waste energy configured as heat generated by a different one of the components 110 of the HVAC system 100.

Figure 2:
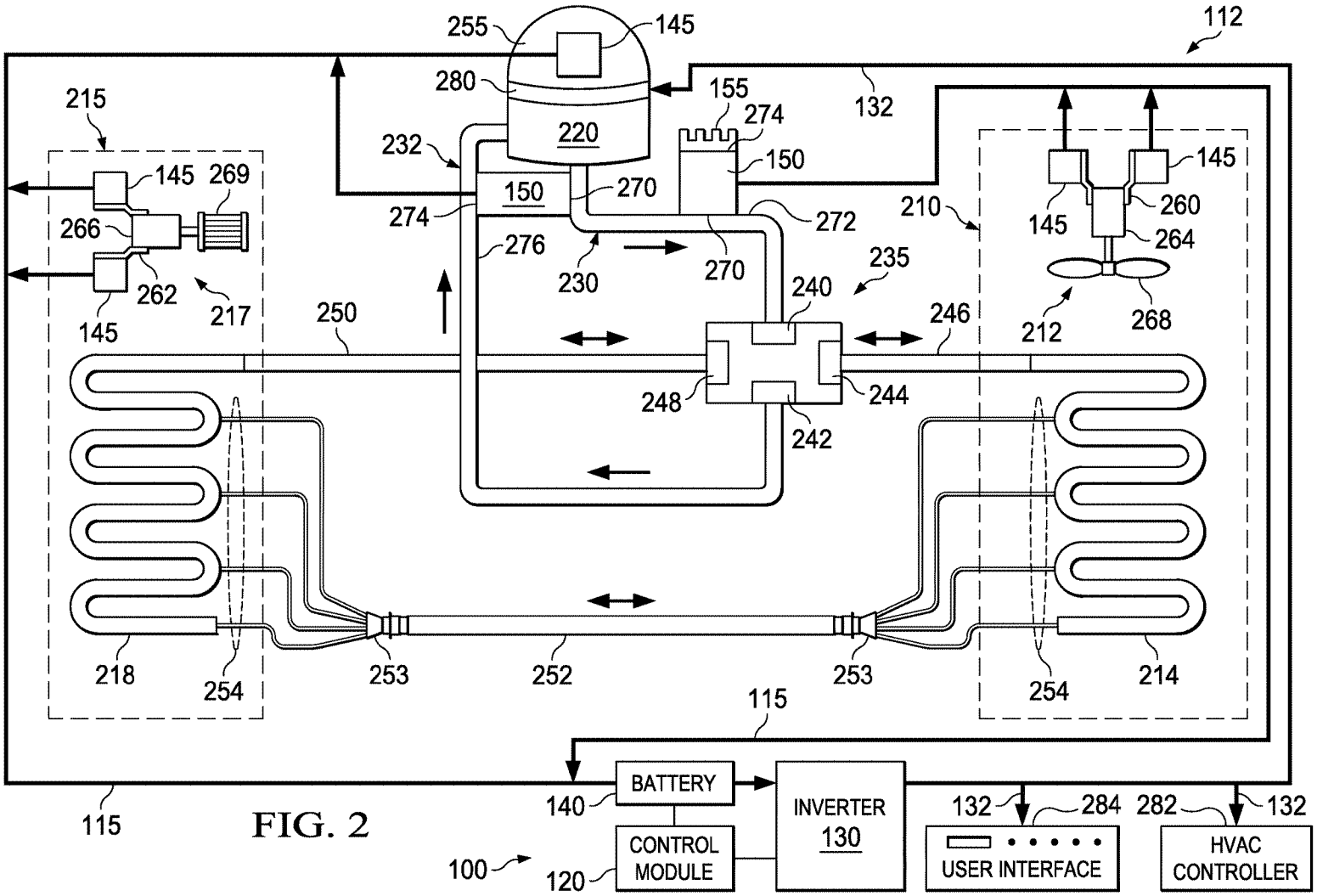
FIG. 2 shows a layout diagram of an example HVAC system that includes an example power-generating system of the disclosure, such as any of the embodiments of the power-generating systems discussed in the context of FIG. 1.

Another embodiment of the disclosure is an HVAC system that comprises the power-generating system. FIG. 2 shows a layout diagram of an example HVAC system 112 that includes an example power-generating system of the disclosure, such as any of the embodiments of the power-generating system 100 discussed in the context of FIG. 1. In some cases, the HVAC system 112 can be configured as a space conditioning system for residential structures or for commercial structures, or as other space conditioning systems well known to those skilled in the art. For instance, in some cases, the HVAC system 112 is configured as a heat pump system.

The HVAC system 112 comprises an outdoor heat exchanger 210, equipped with an outdoor air-mover 212, an indoor heat exchanger 215, equipped with an indoor air-mover 217, and a compressor 220. The compressor 220 is configured to compress a refrigerant, to transfer the refrigerant to a discharge line 230, and, to receive the refrigerant from a suction line 232 of the system 112. The discharge line 230 fluidly connects the condenser 220 to the outdoor heat exchanger 210 and the suction line 232 fluidly connects the indoor heat exchanger 215 to the condenser 220.

As discussed in the context of FIG. 1, the power generating system 100 includes an energy-converting module 105 that converts non-electrical waste energy into electrical energy. The non-electrical waste energy can be generated by one or more components 110 of the system 100 such as one or more of the outdoor air-mover 212, the indoor air-mover 214, the compressor 220, or the discharge line 230 such as depicted in FIG. 2. The power-generating system 100 also includes a control module 120 that directs the electrical energy to one or more electricity-consuming components of the HVAC system 112.

In embodiments where the HVAC system 112 is configured as a heat pump system, the system 112 further includes a reversing valve 235. The reversing valve 235 has an input port 240 coupled to the discharge line 230, an output port 242 coupled to the suction line 232, a first reversing port 244 coupled to a transfer line 246 connected to the outdoor heat exchanger 210, and a second reversing port 248 coupled to a second transfer line 250 connected the indoor heat exchanger 215. As understood by those skilled in the art, the transfer lines 246, 250 allow for the reversal of the flow direction of the refrigerant by actuating the revering valve 235 to put the heat pump system 112 in a cooling mode or a heating mode. One skilled in the art would also appreciate that the HVAC system 112 could further include additional components, such as a connection line 252, distributors 253 and delivery tubes 254 or other components as needed to facilitate the functioning of the system.

The non-electrical waste energy can be generated by any or all of the above mentioned components, and get converted into electrical energy using a variety of different energy-converting modules.

As non-limiting examples, in some cases, the compressor 220 is one of the HVAC components generating waste energy in the form of mechanical vibrations, and in such cases, the energy-converting module includes a piezoelectric module 145. The piezoelectric module 145 can be coupled to an outer surface 255 of the compressor 220. In some cases, the outdoor air-mover 212 (e.g., a condenser fan) or indoor air-mover 217 (e.g., a centrifugal blower), or both, are the HVAC components generating waste energy in the form of mechanical vibrations, and, the energy-converting module includes a piezoelectric module 145 that is coupled to the air-mover 212, 217. For instance, the piezoelectric module can be coupled to the motor mounting arms 260, 262 of electric motors 264, 266 used to drive the propellers 268 or centrifugal wheel 269 of outdoor or indoor air-movers 212, 217, respectively. Based on the present disclosure, one of ordinary skill would appreciate that the piezoelectric module 145 or a plurality of such modules 145 could be coupled to other vibration-producing components of the HVAC system 112 to generate more electrical energy.

As non-limiting examples, in some cases, the discharge line 230 is one of the HVAC components generating waste energy in the form of heat, and in such cases, the energy-converting module includes a thermoelectric module 150, and, the thermoelectric module 150 is coupled to the discharge line 230. In some embodiments, a heat-absorbing side 270 of the thermoelectric module is mounted to an outer surface 272 of the discharge line 230.

In some embodiments, a heat sink 155 is mounted to a heat-rejecting side 274 of the thermoelectric module 150. For instance, a finned metallic heat sink 155 can facilitate heat transfer away from the heat-rejecting side 274. This, in turn, can increase the temperature difference between the heat-absorbing side 270 and heat-rejecting side 274, which as understood by those skilled in the art, increases the amount of waste energy converted into electrical energy by the thermoelectric module 150. For instance, in some embodiments, with the heat-absorbing side 270 of the thermoelectric module 150 coupled to the outer surface 272 of the discharge line 230, the temperature difference between the heat-absorbing side 270 and heat-rejecting side 274 can be a value in a range of about to 70° F. With the same configuration, but, with the heat sink 155 coupled to the heat-rejecting side 274, the temperature difference can be increase by at least about 5 percents, and in some cases, at least about 10 percent.

In some embodiments, the heat-rejecting side 274 of the thermoelectric module 150 is mounted to an outer surface 276 the suction line 232. The lower temperature of refrigerant in the suction line 232, compared to the refrigerant in the discharge line 230, facilitates heat transfer away from the heat-rejecting side 274, thereby increasing the amount of waste energy converted into electrical energy by the thermoelectric module 150. For instance, in some embodiments, with the heat-absorbing side 270 coupled to the outer surface 272 of the discharge line 230, and the heat-rejecting side 274 coupled to the outer surface 276 of the suction line 232, the temperature difference between the heat-absorbing side 270 and heat-rejecting side 274 can be a value in a range of about 60 to 150° F.

Based upon these examples, one of ordinary skill would appreciate how combinations of piezoelectric modules 145 and thermoelectric modules 150 could be coupled to these or other waste energy generating components, as well as to heat sinks 150 and/or suction lines 232, or other components, to enhance the total amount of electrical energy produced by the system 100.

The waste energy converted into electrical energy can be used to power a variety of different electricity-consuming components of the HVAC system 112, as controlled by the control module 120. As non-limiting examples, in some cases, the control module 120 can direct the electrical energy to one or more of a crank-case heater 280, a HVAC controller 282, or a user interface 284 of the HVAC system 112. For instance, the control module 120 can control amounts of alternating current 132, sent from the battery 140 to the inverter 130, to power these components 280, 282, 284, or to other components, when the HVAC system 112 is in an off-cycle. In some embodiments, the control module 120 can be programmed to direct power to the highest power-consuming component, such as the crank-case heater 280, when the HVAC system 112 is in an off-cycle. When the HVAC system is running in an on-cycle, the control module 120 can programmed to direct the converted waste energy as a direct current 115 to the battery 140, or, if the battery is fully charged, to the electric utility grid 135.

Figure 3:
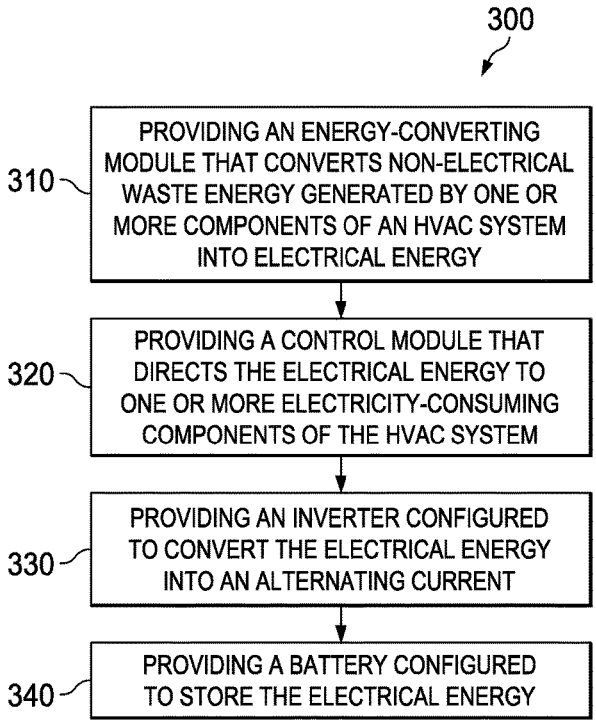
FIG. 3 presents a flow diagram of an example method of assembling a power-generating system, such as any of the systems discussed in the context of FIGS. 1-2.

Still another embodiment of the present disclosure is a method of assembling a power generating system. FIG. 3 presents a flow diagram of an example method 300 of assembling a power-generating system, such as any of the systems 100 discussed in the context of FIGS. 1-2.

With continuing reference to FIGS. 1-3 throughout, the method 300 comprises a step 310 of providing an energy-converting module 105 that converts non-electrical waste energy generated by one or more components 110 (e.g., components 210, 215, 220, 230) of an HVAC system 112, into electrical energy. The method also comprises a step 320 of providing a control module 120 that directs the electrical energy to one or more electricity-consuming components 125 (e.g., components 280, 282, 284) of the HVAC system 112.

Some embodiments of the method 300 further include a step 330 of providing an inverter 130 configured to convert the electrical energy into an alternating current 132, and a step 340 of providing a battery 140 configured to store the electrical energy. As part of providing the providing the control module 120 in step 320, and as discussed in the context of FIGS. 1 and 2, the control module 130 can be programmed to regulate amounts of the electrical energy directed to the electricity-consuming components by the inverter 130, and/or, programmed to regulate amounts of the electrical energy stored in the battery 140.

Those skilled in the art to which this application relates will appreciate that other and further additions, deletions, substitutions and modifications may be made to the described embodiments.

What is claimed:

1. An HVAC system, comprising:

an outdoor heat exchanger equipped with an outdoor air-mover;

an indoor heat exchanger equipped with an indoor air-mover;

a compressor configured to compress a refrigerant and configured to transfer the refrigerant to a discharge line and to receive the refrigerant from a suction line; and a power generating system, including:

an energy-converting module that converts non-electrical waste energy generated by one or more of the indoor air-mover, the outdoor air-mover, the compressor, or the discharge line, into electrical energy, the non-electrical waste energy in a form of both heat and mechanical vibrations, and a control module that directs the electrical energy to a plurality of electricity-consuming components of the HVAC system, wherein at least one of the indoor air-mover, the outdoor air-mover, the compressor, or the discharge line can alternately either generate non-electrical waste energy or comprise one of the plurality of electricity-consuming components;

wherein the energy-converting module includes a thermoelectric module and the thermoelectric module is coupled to the discharge line outside of the compressor, wherein a heat-absorbing side of the thermoelectric module is mounted to an outer surface of the discharge line and configured to transfer heat to the discharge line, and a heat-rejecting side of the thermoelectric module is mounted to an outer surface of the suction line outside of the compressor and configured to receive heat from the suction line.

2. The system of claim 1, wherein the energy-converting module includes a piezoelectric module and the piezoelectric module is coupled to an outer surface of the compressor.

3. The system of claim 1, wherein the energy-converting module includes a piezoelectric module and the piezoelectric module is coupled to the indoor air mover.

4. The system of claim 1, wherein the energy-converting module includes a piezoelectric module and the piezoelectric module is coupled to the outdoor air mover.

5. The system of claim 1, further including a heat sink mounted to a heat-rejecting side of the thermoelectric module.

6. The system of claim 1, wherein the control module directs the electrical energy to one or more of a crank-case heater of the HVAC system, a control circuit of the HVAC system, or a user interface of the HVAC system.

7. A method of operating an HVAC system, comprising:

circulating a refrigerant through an indoor heat exchanger and an outdoor heat exchanger, the outdoor heat exchanger equipped with an outdoor air-mover, and the indoor heat exchanger equipped with an indoor air-mover;

compressing the refrigerant at a compressor configured to transfer the refrigerant to a discharge line and to receive the refrigerant from a suction line; and coupling an energy-converting module to the discharge line and the suction line outside of the compressor, wherein the energy-converting module includes a thermoelectric module and the thermoelectric module is coupled to the discharge line, wherein a heat-absorbing side of the thermoelectric module is mounted to an outer surface of the discharge line and configured to transfer heat to the discharge line, and a heat-rejecting side of the thermoelectric module is mounted to an outer surface of the suction line and configured to receive heat from the suction line, the energy-converting module operable to convert non-electrical waste energy into electrical energy, the non-electrical waste energy in a form of both heat and mechanical vibrations, and coupling a control module to the energy-converting module, the control module operable to direct the electrical energy to a plurality of electricity-consuming components of the HVAC system.

8. The method of claim 7, further including:

providing an inverter configured to convert the electrical energy into an alternating current; and providing a battery configured to store the electrical energy, wherein the control module is programmed to regulate amounts of the electrical energy directed to the electricity-consuming components by the inverter, and the control module is programmed to regulate amounts of the electrical energy stored in the battery.

* * * * *